US010854413B2

(12) United States Patent
Chiu

(10) Patent No.: US 10,854,413 B2
(45) Date of Patent: Dec. 1, 2020

(54) FUSE LINE FIXING STRUCTURE OF FUSE

(71) Applicant: CONQUER ELECTRONICS CO., LTD., Taipei (TW)

(72) Inventor: Hung-Chih Chiu, Taipei (TW)

(73) Assignee: CONQUER ELECTRONICS CO., LTD., Taipei (TW)

( * ) Notice: Subject to any disclaimer, the term of this patent is extended or adjusted under 35 U.S.C. 154(b) by 0 days.

(21) Appl. No.: 16/469,635

(22) PCT Filed: Nov. 27, 2017

(86) PCT No.: PCT/CN2017/113117
§ 371 (c)(1),
(2) Date: Jun. 13, 2019

(87) PCT Pub. No.: WO2019/100382
PCT Pub. Date: May 31, 2019

(65) Prior Publication Data

US 2019/0318894 A1 Oct. 17, 2019

(51) Int. Cl.
*H01H 85/22* (2006.01)
*H01H 85/044* (2006.01)
(Continued)

(52) U.S. Cl.
CPC ..... *H01H 85/22* (2013.01); *H01H 85/044* (2013.01); *H01H 85/143* (2013.01); *H01H 85/2045* (2013.01)

(58) Field of Classification Search
CPC .... H01H 85/22; H01H 85/044; H01H 85/143; H01H 85/2045; H01H 85/1755; H01H 2085/0414
(Continued)

(56) References Cited

U.S. PATENT DOCUMENTS 4,608,548 A * 8/1986 Borzoni ..... H01H 85/0417 337/186
5,923,519 A * 7/1999 Chang ..... H01T 4/08 361/111
(Continued)

FOREIGN PATENT DOCUMENTS

CN 203910723 U * 10/2014
CN 205723413 U * 11/2016
(Continued)

OTHER PUBLICATIONS

Ishii, Wataru; Kabazawa Kazuaki; Lee, Jae Sung; Nakaji, Fumihiro, Shimano, Terumi, "Surface Mount-Current Fuse", Feb. 25, 2011, Entire Document (Translation of KR 101017119). (Year: 2011).*
(Continued)

*Primary Examiner* — Stephen S Sul
(74) *Attorney, Agent, or Firm* — Leong C. Lei

(57) ABSTRACT

A fuse line fixing structure of a fuse includes a base having first and second support sections. The first support section has two sides each forming a first wing and a first concave surface is formed between the first support section and the first wings. First and second electrodes are respectively arranged at two ends of the base. The first electrode includes a first curved plate arranged between the first support section and the first wings. The first curved plate has a convex engagement surface positioned against the first concave surface and a concave engagement surface facing toward an upper side of the first concave surface. The fuse line straddles between the first and second support sections and has an outer circumferential surface in mutual contact, through surface to surface engagement, with the concave engagement surface of the first curved plate.

1 Claim, 8 Drawing Sheets

(51) Int. Cl.
*H01H 85/143* (2006.01)
*H01H 85/20* (2006.01)

(58) Field of Classification Search
USPC ..... 337/186, 187, 190, 198, 205, 273, 282
See application file for complete search history.

(56) References Cited

U.S. PATENT DOCUMENTS

| | | | | |
|---|---|---|---|---|
| 7,248,141 | B2 * | 7/2007 | Kobayashi | B23K 35/262 337/231 |
| 2004/0196134 | A1 * | 10/2004 | Milanczak | H01H 85/547 337/187 |
| 2010/0328020 | A1 * | 12/2010 | Wiryana | H01H 85/175 337/232 |
| 2011/0193675 | A1 * | 8/2011 | Darr | H01H 9/104 337/187 |
| 2012/0133478 | A1 * | 5/2012 | Chiu | H01H 85/165 337/228 |
| 2014/0133059 | A1 * | 5/2014 | Wang | H01H 85/0047 361/103 |
| 2016/0217960 | A1 * | 7/2016 | Abad | H01H 85/175 |

FOREIGN PATENT DOCUMENTS

| | | | | |
|---|---|---|---|---|
| CN | 205881857 U | * | 1/2017 | H01H 85/0411 |
| KR | 20090031280 A | * | 3/2009 | H01H 85/0411 |

OTHER PUBLICATIONS

Yan, Qiongzhang; Yan, Ruizhi, "Improved combination structure of fuse pedestal", Oct. 29, 2014, Entire Document (Translation of CN 203910723). (Year: 2014).*

Ge, Guanghua; Lin, Juliang; Lin, Yiming, "Fuse base subassembly", Jan. 11, 2017, Entire Document (Translation of CN 205881857) (Year: 2017).*

"Written Opinion of the International Search Authority", dated May 31, 2019, Entire Document. (Year: 2019).*

Lin, Lyubei; Xu, Yousheng; Xu, Zhonghou, "Circuit protection device", Nov. 23, 2016, Xiamen Set Electronics Co. LTD, Entire Document (Translation of CN 205723413). (Year: 2016).*

* cited by examiner

FUSE LINE FIXING STRUCTURE OF FUSE

TECHNICAL FIELD OF THE INVENTION

The present invention relates to a fuse line fixing structure of a fuse, which allows a fuse line to be set in mutual contact, through surface to surface engagement, with electrodes so as to increase contact areas between the fuse line and the electrodes, and more particularly to a combination structure between convex engagement surfaces of curved plates of the electrodes and the fuse line and a combination structure between concave engagement surfaces of curved plates of the electrodes and the fuse line.

DESCRIPTION OF THE PRIOR ART

A fuse is a one-time operation device that is connected in a circuit for protection of the circuit and is provided with a fuse line that is made of a metallic wire or a metallic plate. Once a current or a surge in the circuit gets excessively large, or an electrical power is excessively large, the fuse line may be caused to generate a high temperature and gets molten and thus broken, leading to open-circuiting, in order to interrupt transmission of electrical power in the circuit thereby protecting the circuit from burning out.

A known fuse structure includes an electrode provided at each of two ends of an insulator. And, a fuse line is soldered to the two electrodes. In use, the two electrodes of the fuse are individually soldered to a circuit so that electrical power of the circuit may be transmitted from one of the two electrodes through the fuse line to the other one of the electrodes and the circuit.

However, the electrodes of fuses of this kind are often metal plates positioned on a surface of the base so that the metal plates of the electrodes are set on the surface of the base in a straight and flat form. A known fuse line is generally a metallic wire or a metallic filament having a cross-sectional shape that has a circular contour. Thus, the fuse line, when disposed on surfaces of the electrodes, is in contact engagement in a line (the meltable wire) to surface (the electrode) arrangement, resulting in an issue that a contact area between the fuse line and the electrode is hard to enlarge and thus, the performance of electrical transmission and reliability of the fuse, after being assembled with the fuse line, may be affected.

Further, the fuse line of the known fuse, when molten down and broken, may readily undergo phenomena of explosion and electric arcs. Such energy of explosion, if not properly released, may cause explosion of a housing of the fuse and eruption, leading to risks. Thus, the known fuse is provided with a vent hole in the base thereof in order to release the energy of explosion. However, once the fuse is soldered to or bonded to a circuit board or a device, the vent hole formed in the base may be jammed by for example solder or adhesives and thus losing function thereof.

In view of the above, the present inventor, based on years' study and practical experiences, creates a fuse line fixing structure of a fuse to alleviate the shortcomings of the prior art discussed above.

SUMMARY OF THE INVENTION

Thus, the primary objective of the present invention is to provide a fuse line fixing structure of a fuse, which comprises: a base, which comprises a first end, a second end, and an intermediate portion between the first end and the second end, the intermediate portion being provided with a first support section adjacent to the first end and a second support section adjacent to the second end; a first electrode, which is arranged on the first end, the first electrode comprising a first curved plate, the first curved plate comprising a concave engagement surface, the concave engagement surface of the first curved plate being disposed on the first support section; and a fuse line, which is arranged to straddle between the first support section and the second support section, such that an outer circumferential surface of one end of the fuse line is in mutual contact engagement with the concave engagement surface of the first curved plate so as to enlarge a contact area between the fuse line and the first electrode to thereby improve the performance of electricity transmission and reliability of the fuse, after being assembled with the fuse line. The shortcomings of the prior art fuse that the fuse line and the electrodes being set in mutual contact with each other, through line to surface engagement therebetween, makes it hard to enlarge a contact area therebetween and thus affect the performance of electricity transmission and reliability.

In the above structure, the first support section has two sides each of which comprises a first wing, such that a first concave surface is formed between the first support section and the first wings, the first curved plate having a convex engagement surface in contact engagement with the first wings.

In the above structure, a second electrode is arranged on the second end, the second electrode comprising a second curved plate, the second curved plate comprises a concave engagement surface, the concave engagement surface of the second curved plate being disposed on the second support section, an outer circumferential surface of an opposite end of the fuse line being in mutual contact engagement with the concave engagement surface of the second curved plate.

In the above structure, the second support section has two sides each of which comprises a second wing, such that a second concave surface is formed between the second support section and the second wings, the second curved plate having a convex engagement surface in contact engagement with the second wings.

In the above structure, a cavity is arranged between the first support section and the second support section.

In the above structure, a cover is set on and covers the base the intermediate portion and the cavity, such that the fuse line is located in an interior space of the cover.

In the above structure, a through opening is formed in at least one of a top surface and a lateral surfaces of the cover and in communication with the cavity, in order to avoid loss of functionality of the through opening due to being jammed.

In the above structure, the first concave surface and the second concave surface are each a concave surface in the form of an arc form or a folded form, the outer circumferential of the one end of the fuse line being in mutual contact, through surface to surface engagement, with the concave engagement surface of the first curved plate, the outer circumferential surface of the opposite end of the fuse line being in mutual contact, through surface to surface engagement, with the concave engagement surface of the second curved plate.

In the above structure, an insulation layer is filled between the one end of the fuse line and the first support section and the first wings and another insulation layer is filled between the opposite end of the fuse line and the second support section and the second wings.

To clearly and fully disclose the present invention, drawings showing preferred embodiments are provided for detailed explanation of the embodiments in the following.

DETAILED DESCRIPTION OF THE PREFERRED EMBODIMENT

Figure 1:
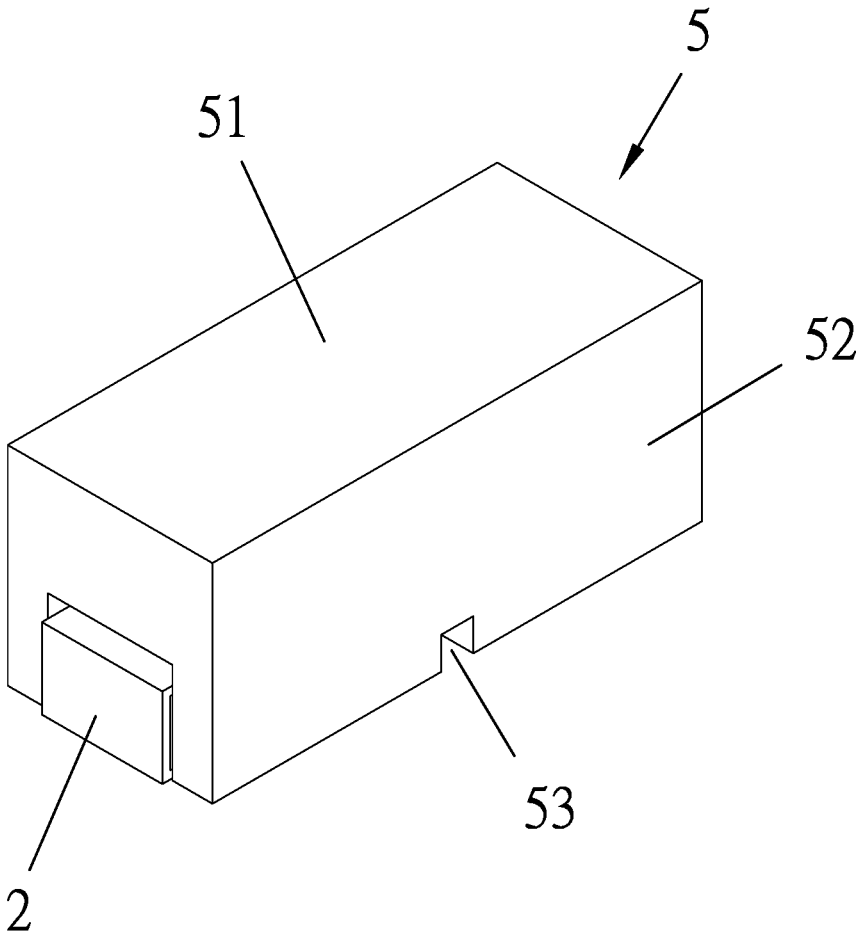
FIG. 1 is a perspective view showing a preferred embodiment of the present invention.

Referring to FIGS. 1-4, which are drawings that disclose embodiments of the present invention, as shown in these drawings, the present invention provides a fuse line fixing structure of a fuse, comprising a combined arrangement of a base 1, a first electrode 2, a second electrode 3, a fuse line 4, and a cover 5. The base 1 comprises a first end 11, a second end 12, and an intermediate portion 13 located between the first end 11 and the second end 12. The intermediate portion 13 is provided with a first support section 14 arranged adjacent to the first end 11, a second support section 15 adjacent to the second end 12, and a cavity 16 between the first support section 14 and the second support section 15. The first electrode 2 is arranged on the first end 11 of the base 1, and the second electrode 3 is arranged on the second end 12 of the base 1.

In a preferred embodiment, the first support section 14 has two opposite sides each comprising a first wing 141, 142, such that a first concave surface 140 is formed between the first support section 14 and the first wings 141, 142. The first electrode 2 has an end that is formed with a first curved plate 21 extending into a space between the first support section 14 and the first wings 141, 142, and the first electrode 2 has an opposite end that is extended to an underside of the first end 11 of the base 1 to serve as a soldering terminal. The first curved plate 21 has two surfaces, a lower surface and an upper surface, which are respectively a convex engagement surface 211 positioned against the first wings 141, 142 and the first concave surface 140 and a concave engagement surface 212 facing toward an upper side of the first concave surface 140, such that the concave engagement surface 212 of the first curved plate 21 is disposed on the first support section 14. The second support section 15 has two opposite sides each comprising a second wing 151, 152, such that a second concave surface 150 is formed between the second support section 15 and the second wings 151, 152. The second electrode 3 has an end that is formed with a second curved plate 31 extending into a space between the second support section 15 and the second wings 151, 152, and the second electrode 3 has an opposite end that is extended to an underside of the second end 12 of the base 1 to serve as a soldering terminal. The second curved plate 31 has two surfaces, a lower surface and an upper surface, which are respectively a convex engagement surface 311 positioned against the second wings 151, 152 and the second concave surface 150 and a concave engagement surface 312 facing toward an upper side of the second concave surface 150, such that the concave engagement surface 312 of the second curved plate 31 is disposed on the second support section 15. The fuse line 4 is arranged to straddle between the first support section 14 and the second support section 15 and is suspended above the cavity 16, so that an outer circumferential surface of an end of the fuse line 4 is set in mutual contact, through surface to surface engagement, with the concave engagement surface 212 of the first curved plate 21, and an outer circumferential surface of an opposite end of the fuse line 4 is set in mutual contact, through surface to surface engagement, with the concave engagement surface 312 of the second curved plate 31.

The drawings also show that the cover 5 is set on and cover the first support section 14, the second support section 15, and the cavity 16 of the intermediate portion 13 of the base 1 so as to house the fuse line 4 in an interior of the cover 5.

Figure 5:
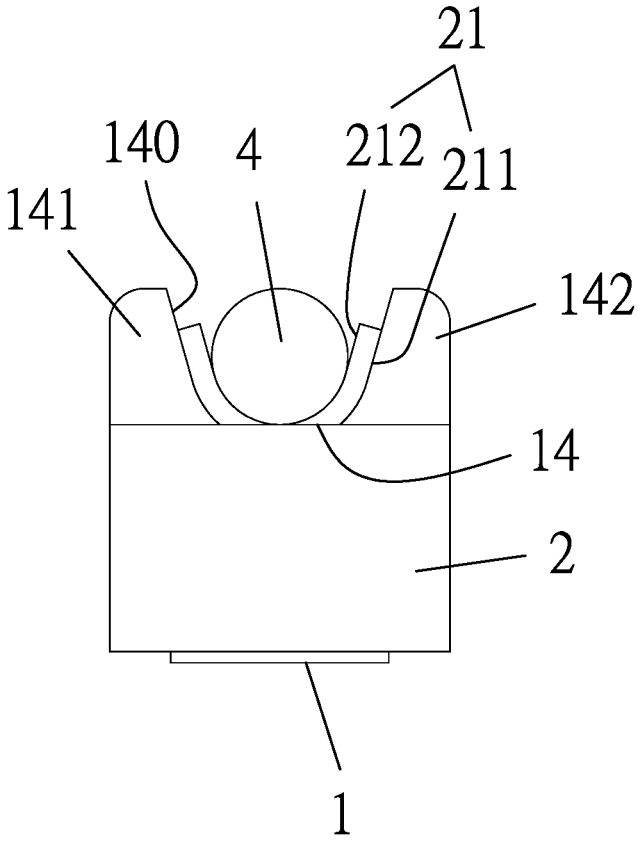
FIG. 5 is a schematic view illustrating an arrangement of a base and a meltable wire shown in FIG. 2.
Figure 6:
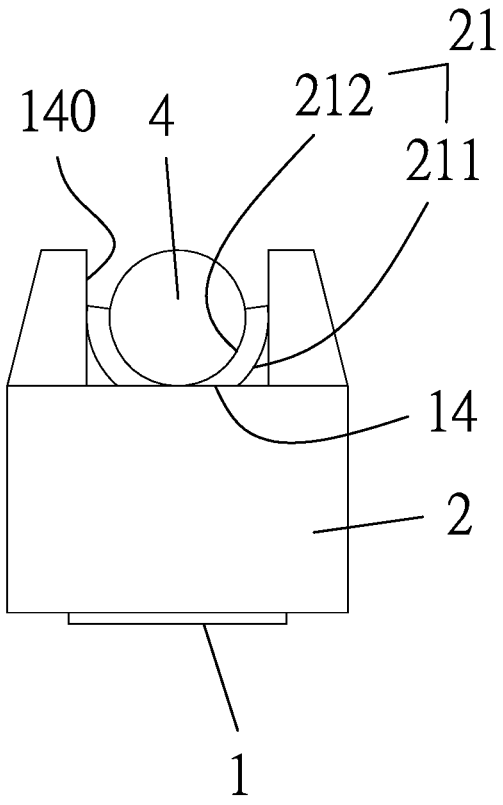
FIG. 6 is a schematic view illustrating a modified example of the arrangement of FIG. 5.
Figure 7:
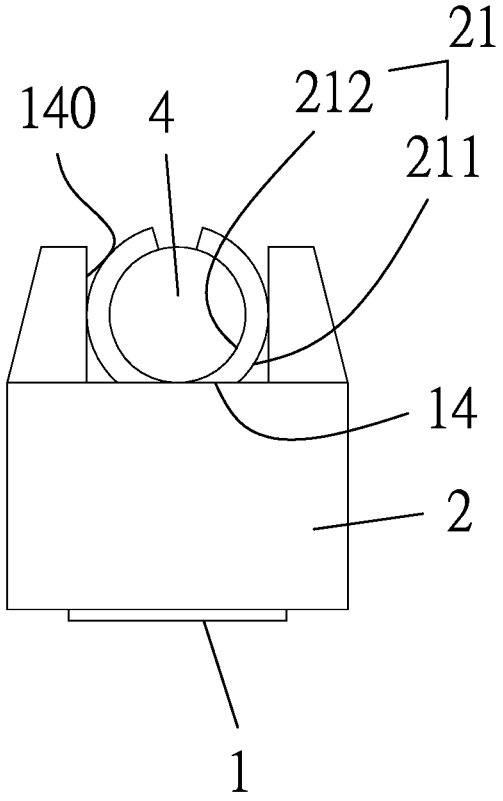
FIG. 7 is a schematic view illustrating another modified example of the arrangement of FIG. 5.
Figure 8:
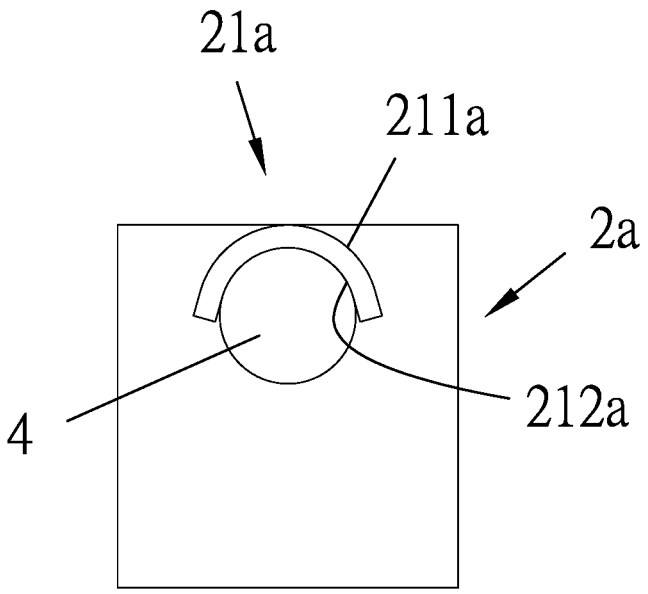
FIG. 8 is a schematic view illustrating an arrangement of another embodiment.

Referring to FIG. 5, in a feasible embodiment, the first concave surface 140 and the second concave surface 150 can be arranged as concave surfaces in an arc form. Referring to FIGS. 6 and 7, illustration is provided to show that the first concave surface 140 and the second concave surface 150 can also be made as concave surfaces in a folded form. Referring to FIG. 8, illustration is provided to show the first curved plate 21*a* of the first electrode 2*a* may be arranged to have a convex engagement surface 211*a* that faces toward an upper side and a concave engagement surface 212*a* that faces toward a lower side, such that an end of the fuse line 4 can be set in connection engagement with the concave engagement surface 212*a* of the first curved plate 21*a*; and the second curved plate of the second electrode may be similarly arranged to have a convex engagement surface that faces toward an upper side and a concave engagement surface that faces toward a lower side, such that an opposite end of the fuse line can be set in connection engagement with the concave engagement surface of the second curved plate.

It can be appreciated that that the structural arrangement that the outer circumferential surface of one end of the fuse line 4 is set in mutual contact, through surface to surface engagement, with the concave engagement surface 212 of the first curved plate 21 and the outer circumferential surface of an opposite end of the fuse line 4 is set in mutual contact, through surface to surface engagement, with the concave engagement surface 312 of the second curved plate 31, contact surface areas the first electrode 2 and the second electrode 3 with the fuse line 4 are increased to thereby enhance the performance of electrical transmission and the reliability of the fuse, after being assembled with the fuse line 4.

Figure 2:
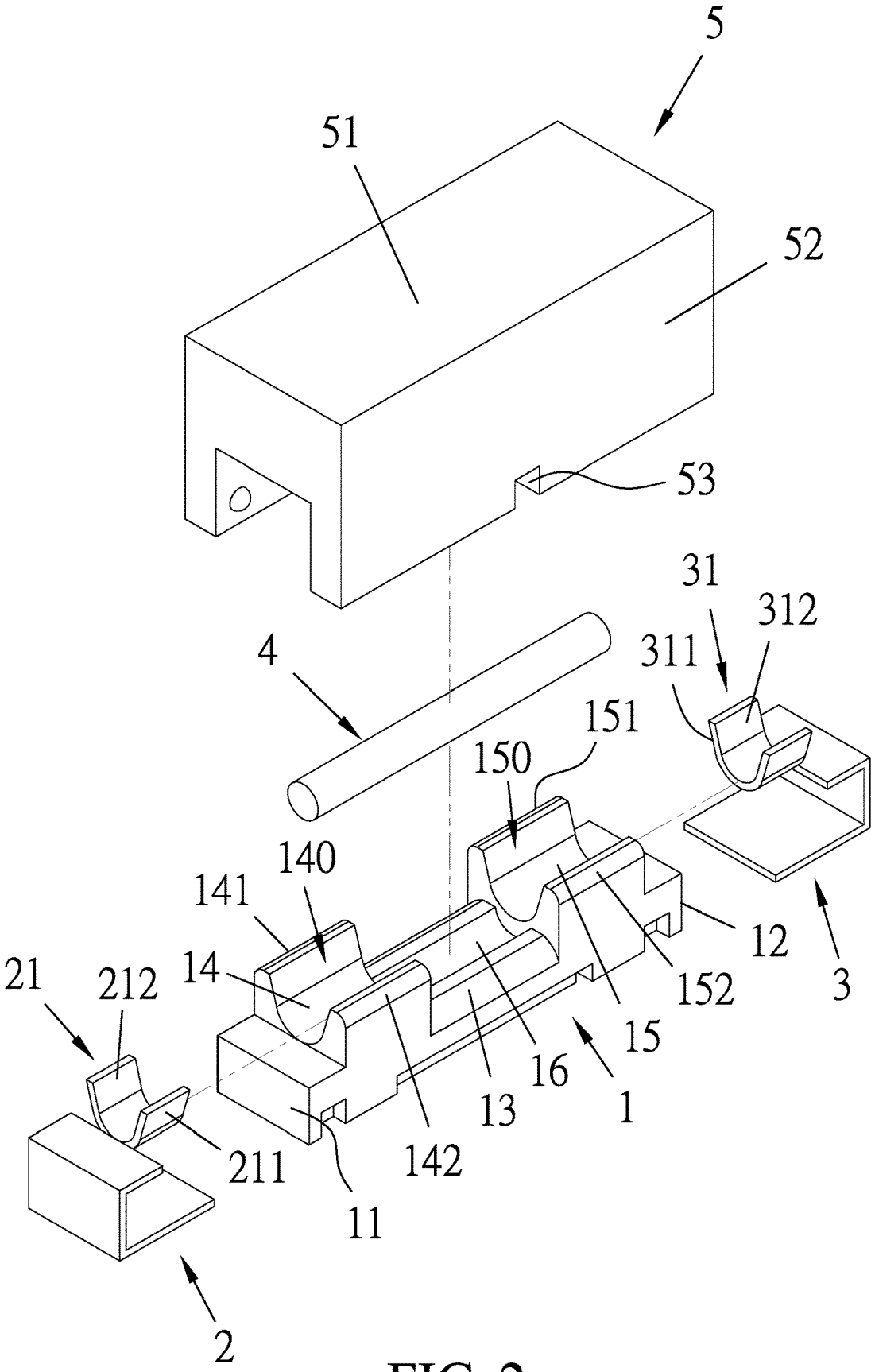
FIG. 2 is an exploded view of FIG. 1.
Figure 4:
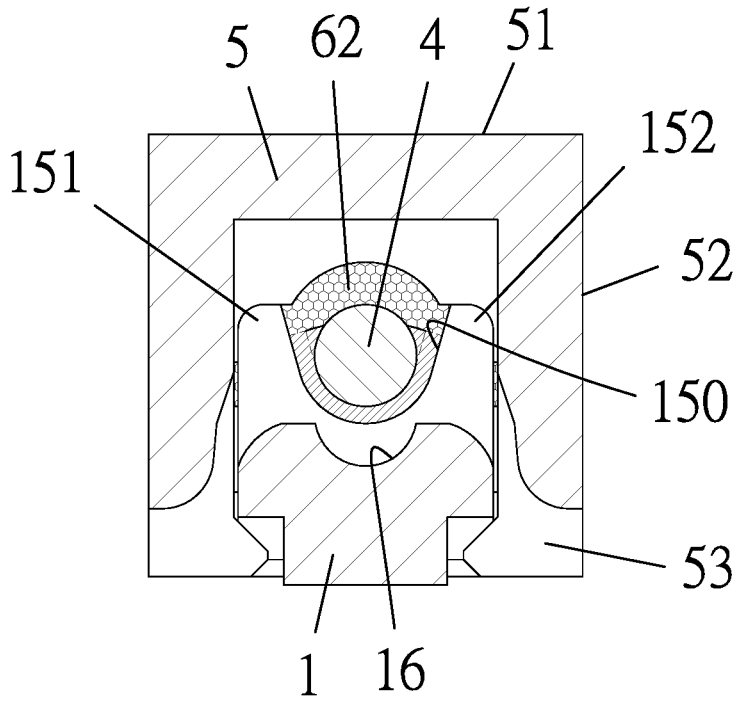
FIG. 4 is a cross-sectional view, taken in a lateral direction, of FIG. 1.

As shown in FIGS. 1, 2, and 4, in another feasible embodiment, the cover 5 is provided, in a top surface 51 or a lateral surface 52, with a through opening 53 in communication with the cavity 16, such that the through opening 53 is located at a joint portion between the cover 5 and the base 1. The through opening 53 may release energy of explosion generated when the fuse line 4 is molten and broken. As such, when the base 1 is soldered to or adhered to a circuit board or a surface of a device, since the through opening 53 is provided on the cover 5, instead of the through opening being formed in the base, the through opening 53 is kept away from solder or adhesive on the circuit board or the device so as to prevent the through opening 53 from losing functionality as being jammed by the solder or adhesive.

Figure 3:
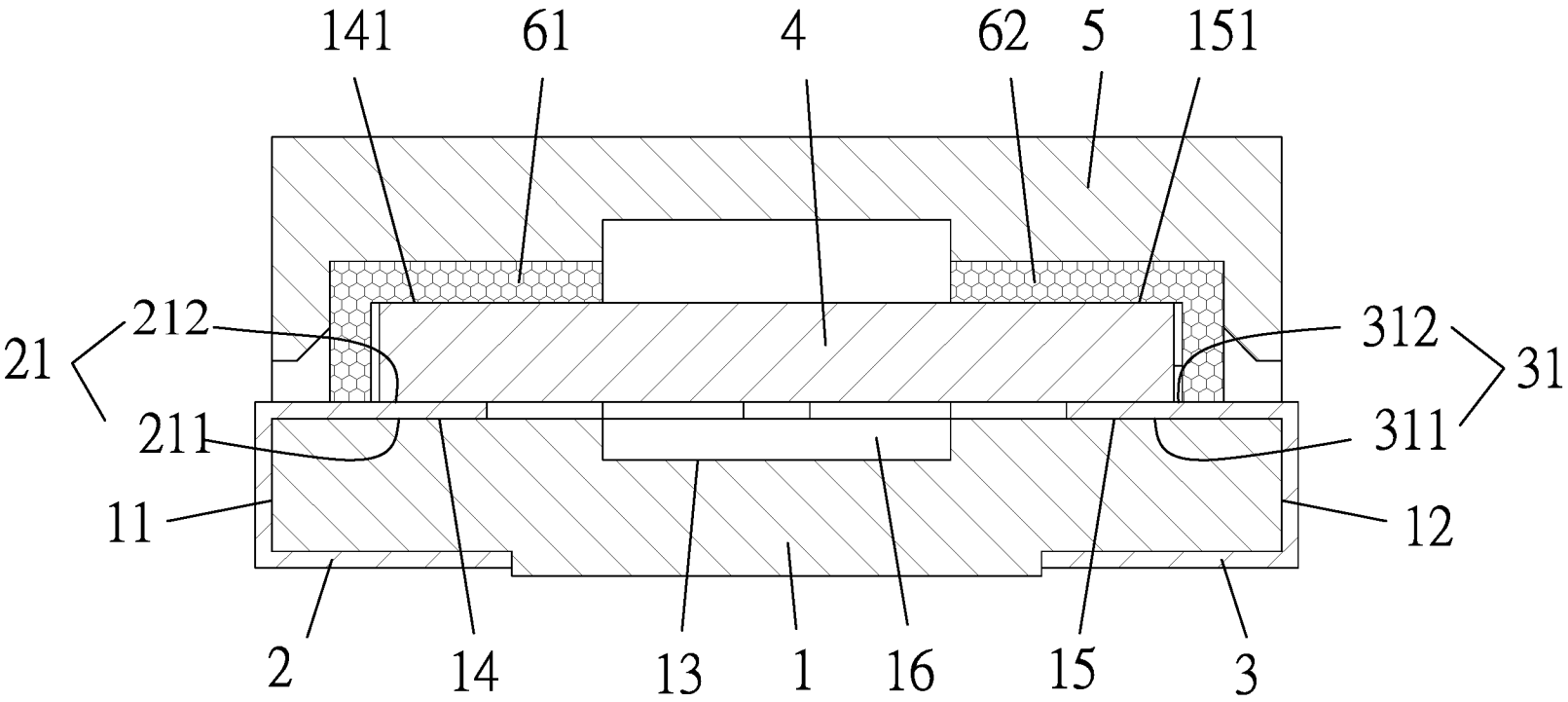
FIG. 3 is a cross-sectional view, taken in a longitudinal direction, of FIG. 1.

As shown in FIGS. 3 and 4, in a further feasible embodiment, an insulation layer 61 is filled between one end of the fuse line 4 and the first support section 14 and the first wings 141, 142, and another insulation layer 62 is filled between an opposite end of the fuse line 4 and the second support section 15 and the second wings 151, 152. The insulation layers 61, 62 wrap around the two ends of the fuse line 4 to reduce the size of the portion of the fuse line 4 exposed in the cavity 16. During assembling of the base 1 and the cover 5, the insulation layers 61, 62 provide an effect of cushioning that ensures, during assembling, contact points of the first wings 141 and the second wings 151 are not suffering structure damage due to compression thereby providing an effect of protection.

The description provides preferred embodiments of the present invention, and is not intended to constrain the scope of embodiment of the present invention. Variations and modifications that are readily contemplated by those having ordinary skill in the art are considered belonging to the substantive scope of the present invention.

I claim:

1. A fuse line fixing structure of a fuse, comprising:

a base, which comprises a first end, a second end, and an intermediate portion between the first end and the second end, the intermediate portion being provided with a first support section adjacent to the first end and a second support section adjacent to the second end;

a first electrode, which is arranged on the first end, the first electrode comprising a first curved plate, the first curved plate comprising a concave engagement surface, the concave engagement surface of the first curved plate being disposed on the first support section; and a fuse line, which is arranged to straddle between the first support section and the second support section, such that an outer circumferential surface of one end of the fuse line is in mutual contact engagement with the concave engagement surface of the first curved plate;

wherein the first support section has two sides each of which comprises a first wing, such that a first concave surface is formed between the first support section and the first wings, the first curved plate having a convex engagement surface in contact engagement with the first wings;

wherein a second electrode is arranged on the second end, the second electrode comprising a second curved plate, the second curved plate comprises a concave engagement surface, the concave engagement surface of the second curved plate being disposed on the second support section, an outer circumferential surface of an opposite end of the fuse line being in mutual contact engagement with the concave engagement surface of the second curved plate;

wherein the second support section has two sides each of which comprises a second wing, such that a second concave surface is formed between the second support section and the second wings, the second curved plate having a convex engagement surface in contact engagement with the second wings;

wherein a cavity is arranged between the first support section and the second support section;

wherein a cover is set on and covers the base the intermediate portion and the cavity, such that the fuse line is located in an interior space of the cover;

wherein a through opening is formed in at least one of a top surface and a lateral surfaces of the cover and in communication with the cavity;

wherein the first concave surface and the second concave surface are each a concave surface in the form of an arc form or a folded form, the outer circumferential of the one end of the fuse line being in mutual contact, through surface to surface engagement, with the concave engagement surface of the first curved plate, the outer circumferential surface of the opposite end of the fuse line being in mutual contact, through surface to surface engagement, with the concave engagement surface of the second curved plate; and wherein an insulation layer is filled between the one end of the fuse line and the first support section and the first wings and another insulation layer is filled between the opposite end of the fuse line and the second support section and the second wings.

* * * * *